United States Patent [19]

Toland

[11] 4,268,572

[45] May 19, 1981

[54] SULFUR-BASED ROOF SHINGLES

[75] Inventor: William G. Toland, San Rafael, Calif.

[73] Assignee: Chevron Research Company, San Francisco, Calif.

[21] Appl. No.: 97,084

[22] Filed: Nov. 23, 1979

Related U.S. Application Data

[63] Continuation-in-part of Ser. No. 949,704, Oct. 10, 1978, abandoned, which is a continuation of Ser. No. 781,593, Mar. 28, 1977, abandoned.

[51] Int. Cl.[3] ..... B32B 11/00; D06N 7/00

[52] U.S. Cl. ..... 428/281; 428/283; 428/285; 428/288; 428/289; 428/290; 428/291; 428/921

[58] Field of Search ..... 428/281, 283, 285, 288, 428/289, 290, 291, 149, 150, 241, 921

[56] References Cited

U.S. PATENT DOCUMENTS

| | | | |
|---|---|---|---|
| 3,440,064 | 4/1969 | Ludwig | 106/287 SC |
| 3,619,258 | 11/1971 | Bennett | 428/265 |
| 3,721,578 | 3/1973 | Bennett | 428/265 |
| 4,026,719 | 5/1977 | Simic | 106/287 SC |
| 4,076,885 | 2/1978 | Brossel | 428/291 |
| 4,079,158 | 3/1978 | Kennepohl | 428/291 |
| 4,135,022 | 1/1979 | Kennepohl | 428/291 |

OTHER PUBLICATIONS

Ito et al., *Flame-Retardant Acrylonitrile Fibers*, (1971), Chemical Abstracts, vol. 75, 99234n.

Boll et al., *Powdered Fire-Extinguishing Agents Based on Ammonium Polyphosphates*, (1971), Chemical Abstracts, vol. 75, 78723f.

Sonnerstein et al., *Dry-Fire Extinguishing Powder*, (1971), Chemical Abstracts, vol. 74, 143948d.

*Primary Examiner*—Marion McCamish

*Attorney, Agent, or Firm*—J. A. Buchanan, Jr.; D. A. Newell; J. Stoner, Jr.

[57] ABSTRACT

Sulfur-based roof shingles which consist essentially of a fibrous base mat coated on at least one surface with a plasticized-sulfur composition were found to have surprising flexibility and fire resistance when compared to similar asphalt shingles.

10 Claims, No Drawings

SULFUR-BASED ROOF SHINGLES

CROSSREFERENCE TO RELATED APPLICATIONS

This application is a continuation-in-part of U.S. Ser. No. 949,704, filed Oct. 10, 1978 and now abandoned, which in turn is a continuation of U.S. Ser. No. 781,593, filed Mar. 28, 1977, now abandoned.

BACKGROUND OF THE INVENTION

The invention concerns the use of plasticized sulfur to prepare a flexible, fire-resistant roof shingle. In the past, the relative economics of asphalt and sulfur would not have suggested the usefulness of sulfur technology in the roof shingle industry. However, the recent availability of sulfur and the increased cost of petroleum-derived products have led to a variety of reasons to consider the application of sulfur.

Despite the economic incentives, the use of sulfur in roof shingles has been slow in developing due to a number of serious shortcomings. In particular, sulfur is an extremely brittle solid and will not withstand the stresses to which a roof shingle is subjected. For example, a roof shingle is nailed into position. Shingles made from sulfur must be pre-drilled to avoid splitting when nailed. In many applications, roof shingles need to be flexible enough to withstand the weight of a heavy snowfall at sub-zero temperatures. Again, shingles made from sulfur have not been strong enough to withstand considerable weight.

Perhaps the most serious shortcoming concerns the combustibility of sulfur. Sulfur roofing materials burn with excessive melting of the sulfur, which in turn flows and drips, transporting the fire with it. Thus, the fire is spread to other areas of the structure. Moreover, burning sulfur generates large amounts of sulfur oxides, posing a severe pollution problem.

Some attempts have been made to reduce the combustibility of sulfur by incorporating various flame retardants into the sulfur. For example, U.S. Pat. No. 1,835,767, granted Dec. 8, 1931, describes the use of sulfur resins to retard the combustion of sulfur. However, when the composition is applied to a fibrous or paper backing the laminated product loses its flexibility, becoming very stiff. Similarly, Dale and Ludwig, "Fire-Retarding Elemental Sulfur", Journal of Materials, Vol. 2, No. 1, March 1967, p. 131, describe the effect of a variety of materials on the combustibility of sulfur with either styrene or dipentene dimercaptan. The "fire-proof" compositions were suggested as wall coatings, presumably because they form a firm, inflexible coating.

Attempts have been made to prepare flexible cloth-like products using plasticized sulfur as a third coating over the product. U.S. Pat. No. 3,619,258, granted Nov. 9, 1971, to Bennett, and U.S. Pat. No. 3,721,578, granted Mar. 20, 1973, to Bennett describe the use of thin coatings of plasticized-sulfur compositions over an asphalt-impregnated fabric to prepare a flexible, water-proof product. The thin coating of plasticized sulfur is used to improve the weather-proof characteristics of the final product.

SUMMARY OF THE INVENTION

It has now been found that a non-asphaltic sulfur-based roof shingle consisting essentially of a fibrous base mat impregnated with a plasticized-sulfur composition comprising from about 30 to 98% sulfur exhibits good fire resistance and flexibility.

DETAILED DESCRIPTION OF THE INVENTION

The roof shingles of this invention do not contain asphalt and can be prepared using conventional manufacturing approaches. However, the preferred method of manufacture is the dipping process typically used to manufacture conventional asphalt shingles. According to the method, a standard fibrous mat is run continuously through a dryer and is fed into a vat of molten asphalt-free plasticized-sulfur composition to saturate the mat and insure its impregnation. The saturated mat is squeezed between rollers to insure uniform thickness. Roofing granules are applied, and the mat is run through a water-cooled press roller. Finally, the mat is cut to the desired shape.

The fibrous base mat can be any of the standard shingle mats. Suitable mats include those used in the production of asphalt shingles. Presently most shingles are prepared using either glass fiber mats or cellulose fiber mats, and these mats are preferred. Glass fiber mats offer additional fire resistance, and are especially preferred. Binders may be added to the fibrous mat or the thickness of the mat can be varied to improve strength. Good results have been obtained using a 6.0 gram per square foot glass fiber mat with polystyrene binder.

Any suitable plasticized-sulfur composition free of asphalt but containing sulfur, plasticizer, and, optionally, fillers, pigments, dyes, and the like, can be used. Suitable plasticized-sulfur compositions preferably contain at least 30%, by weight, sulfur. In general, the compositions are composed of from about 30% to 98% sulfur, from about 0.2% to 20% plasticizer, and from about 1 to about 70% filler. Preferably the compositions contain from 50% to 85% sulfur, from 1% to 5% plasticizer and from 10% to 49% filler.

Fillers for use in this composition include fibers such as those made from glass, asbestos, carbon, etc.; particulate solids such as sand, hydrated alumina, mica, calcium carbonate, talc, ammonium polyphosphate, clay, calcium sulfate, antimony oxide, borax, zinc borate, titanium dioxide, iron oxide, molybdenum trioxide, magnesium hydroxide, ferric chloride, etc.; inert, high-melting, fire-retardant organic compounds, in particular those that are essentially insoluble in sulfur, especially halogenated cyclopentadiene oligomers and haloaromatics such as tetrabromophthalic anhydride, and halogenated bisphenols, e.g., tetrabromobisphenol-A.

Especially preferred plasticized-sulfur compositions are described in U.S. patent application Ser. No. 631,781, filed Nov. 13, 1975, by Simic now U.S. Pat. No. 4,026,719. The disclosure of that application is incorporated herein by reference. The plasticized-sulfur compositions of that application include, in addition to sulfur and plasticizer, mica as a filler. In general, the compositions are composed of from about 50% to 98% sulfur, from about 0.2% to 20% plasticizer, and from 5% to 20% mica.

The plasticized-sulfur composition is usually prepared in molten form by adding the plasticizer to molten sulfur and heating the resulting mixture at a temperature above the melting point, e.g., at a temperature between 110° C. and 180° C., preferably between about 125° C. and 150° C. Fillers, pigments, flame retardants, etc., are then added, and the resulting composition is mixed until homogenous. It is then used to impregnate shingle mats as described above.

The composition also includes a sulfur plasticizer. A sulfur plasticizer is used to mean something that plasticizes sulfur or results in plasticized sulfur. In turn, "plasticized sulfur" as the term is used herein usually has a slightly lower melting point then elemental sulfur. Furthermore, plasticized sulfur requires a longer time to crystallize; i.e., the rate of crystallization of plasticized sulfur is slower than that of elemental sulfur. One useful way to measure the rate of crystallization is as follows: the test material (0.040 g) is melted on a microscope slide at 130° C. and is then covered with a square microscope slide cover slip. The slide is transferred to a hot plate and is kept at a temperature of 78±2° C., as measured on the glass slide using a surface pyrometer. One corner of the melt is seeded with a crystal of test material. The time required for complete crystallization is measured. Plasticized sulfur, then, is sulfur containing an additive which increases the crystallization time within experimental error, i.e., the average crystallization time of the plasticized sulfur is greater than the average crystallization time of the elemental sulfur feedstock. For the present application, plasticizers are those substances which, when added to molten elemental sulfur, cause an increase in crystallization time in reference to the elemental sulfur itself.

Inorganic plasticizers include iron, arsenic and phosphorus sulfides, but the particularly preferred plasticizers are organic compounds which react with sulfur to give sulfur-containing materials.

Sulfur plasticizers which are suitable include aliphatic polysulfides, aromatic polysulfides, styrene, dicyclopentadiene, dioctylphthalate, acrylic acid, epoxidized soybean oil, triglycerides, and tall oil fatty acids.

One class of preferred plasticizers is the aliphatic polysulfides, particularly those that will not form cross-linking. Thus butadiene is not a preferred constituent to form the aliphatic polysulfide, as it may form cross-linking sulfur bonds, whereas dicyclopentadiene is a preferred compound for forming the aliphatic polysulfide useful as the sulfur plasticizer. With molten sulfur, dicyclopentadiene forms an extremely satisfactory aliphatic polysulfide.

Another class of preferred plasticizers for use in the compositions are aromatic polysulfides formed by reacting one mol of an aromatic carbocyclic or heterocyclic compound, substituted by at least one functional group of the class —OH or —NHR in which R is H or lower alkyl with at least two mols of sulfur.

Suitable aromatic compounds of this type include: phenol, aniline, N-methyl aniline, 3-hydroxy thiophene, 4-hydroxy pyridine, p-aminophenol, hydroquinone, resorcinol, meta-cresol, thymol, 4,4'-dihydroxy biphenyl, 2,2-di(p-hydroxyphenol)propane, di(p-hydroxy phenyl)methane, etc., p-phenylene diamine, methylene, dianiline. Phenol is an especially preferred aromatic compound to form the aromatic polysulfide.

The aromatic polysulfides are generally prepared by heating sulfur and the aromatic compound at a temperature in the range of 120° to 170° C. for 1 to 12 hours, usually in the presence of a base catalyst such as sodium hydroxide. (See for example, Angew, Chem. V70, No. 12, pages 351–67 (1958)). The polysulfide product made in this way has a mol ratio of aromatic compound:sulfur of 1:2 to 1:10, preferably from 1:3 to 1:7. Upon completion of the reaction, the caustic catalyst is neutralized with an acid such as phosphoric or sulfuric acid. Organic acids may also be used for this purpose. The resulting aromatic polysulfide may be used immediately or it may be cooled and stored for future use.

Another type of aliphatic polysulfide useful as a plasticizer is the linear aliphatic polysulfides. Although these polysulfides may be used alone as the sulfur plasticizer, it is preferred to use them in combination with either (a) dicyclopentadiene or (b) the aromatic polysulfides described above, especially with the phenol-sulfur adduct. In this connection, the preferred plasticizer mixtures contain from 5 to 60% linear aliphatic polysulfide by weight based on total plasticizer, preferably about 10 to 30 weight percent.

These aliphatic polysulfides may have branching indicated as follows:

$$-\underset{\underset{B}{|}}{C}=C + S \longrightarrow -S_x-C-\underset{\underset{B}{|}}{C}-S_x-$$

wherein x is an integer of from 2 to 6 and wherein B is H, alkyl, aryl, halogen, nitrile, ester or amide group. Thus in this connection the aliphatic polysulfide is preferably a linear polysulfide. The chain with the sulfur preferably is linear, but it can have side groups as indicated by "B" above. Also, this side group "B" may be aromatic. Thus styrene can be used to form a phenyl substituted linear aliphatic polysulfide. The preferred aliphatic polysulfides of this type are both linear and non-branched.

Unbranched linear aliphatic polysulfides include those such as Thiokol LP-3 which contains an ether linkage and has the recurring unit:

$$-S_xCH_2CH_2OCH_2OCH_2CH_2S_x-$$

wherein x has an average value of about 12. The ether constituent of this aliphatic polysulfide is relatively inert to reaction. Other suitable aliphatic polysulfides have the following recurring units:

$-S_x(CH_2)_yS_x-$ from reaction of α,ω-dihaloalkanes and sodium polysulfide $-S_x(CH_2CH_2-S-CH_2CH_2)S_x-$ from reaction of α,ω-dihalosulfides and sodium polysulfide $-S_x(CH_2CH_2-O-CH_2CH_2)S_x-$ from reaction of α,ω-dihaloesters and sodium polysulfide wherein x is an integer of 2 to 5; and y is an integer of 2 to 10.

Mica is an important element of the preferred plasticized-sulfur compositions. The term "mica" is used herein to mean a layered silicate having an x-ray diffraction pattern d spacing about 9.6 to 10.1 A, preferably a d spacing of about 9.9 to 10.1 A. Talc material also is a layered silicate, but has a d spacing of about 9.35 A. Satisfactory mica particles cover a very broad range of sizes. It is preferred that at least 90% pass through a 40-mesh (Tyler) screen. Satisfactory particles have sizes ranging in diameter from 0.001 to 2 mm and in thickness from 0.0005 to 0.2 mm.

Typical amounts of mica in the formulation are about 1 to 40 weight percent, preferably 5 to 30 weight percent, and particularly preferred amounts are 10 to 20 weight percent.

Preferred micas for use in the composition of the present invention are phlogopite, muscovite, zinnwaldite and biotite, which are natural micas, and fluorophlogopite and barium disilic, which are synthetic micas.

Particularly preferred micas for use in the present invention contain potassium and have a chemical composition of $3Al_3O_3.K_2.6SiO_2.2H_2O$, also written $K_2Al_4.(Al_2Si_6O_{20})(OH)_4$. Mica differs from talc in that talc typically does not contain potassium. Kirk-Othmer Encyclopedia of Chemical Technology, 2d Ed., Vol. 19, page 608, gives the following chemical formula for talc: $Mg_3SiO_{10}(OH)_2$.

In order to give the sulfur-based shingles of the present invention a conventional appearance, standard roofing granules of various colors can be applied to the shingle while the plasticized-sulfur composition is still tacky. Any suitable roofing granule can be used, such as those presently available from the Industrial Mineral Products Division of the 3M Company. Since all that is seen of any shingle after it is attached to a roof is the top, sulfur-based shingles having roofing granules embedded on the top surface have much the same general appearance as asphalt shingles even though the sulfur-based shingles contain no asphalt. A small amount of dye, such as carbon black, could even be used to make the plasticized sulfur appear as conventional asphalt.

EXAMPLES

The following examples illustrate the invention and are not intended to limit the scope of the claims which follow.

EXAMPLE 1

The standard method of rating roofing coverings for fire resistance is ASTM E-108, "Fire Tests of Roof Coverings". Using a scaled-down version of this test, so that smaller roof test decks could be used and combustibility of the shingles could be examined as limiting factor, test roof decks 22" wide by 4' long were constructed from 2"×4" rafters covered with ½" plywood decking. These were covered with conventional 15-pound asphalt-impregnated roofing felt.

Sulfur-based shingles 12" wide by 22" long were hand-cast using the plasticized-sulfur compositions of Table I with one thickness of fiber glass mat and a top coating of roofing granules.

TABLE I

| Plasticized-Sulfur Compositions | A | B | C | D | E |
|---|---|---|---|---|---|
| Sulfur, % | 84 | 61.9 | 61 | 49 | 81.5 |
| Dicyclopentadiene, % | 2 | 2.0 | 2 | 1 | 1.0 |
| Mica, % | 12 | 5.0 | 5 | — | 17 |
| Glass Fiber, % | 2 | 2.0 | 2 | 2 | — |
| Sand (120 mesh), % | — | — | — | 24 | — |
| Hydrated alumina, % | — | 25.0 | 30 | 24 | — |
| Tetrabromophthalic anhydride, % | — | 3.6 | — | — | — |
| Ammonium polyphosphate, % | — | 0.5 | — | — | — |
| Thiokol LP-3, % | — | — | — | — | 0.5 |

The shingles had the following approximate composition by weight:

| | |
|---|---|
| Glass Fiber | 12 grams |
| Plasticized Sulfur | 780 grams |
| Granules | 440 grams |
| Total | 1232 grams |

Conventional Class C asphalt shingles of the same dimensions weigh approximately 1300 grams. Thus, for all intents and purposes, the non-asphaltic sulfur-based shingles of this invention are comparable to Class C asphalt shingles.

Each of the four types of sulfur-based shingles A–D was then nailed onto a test roof deck with conventional aluminum roofing nails, using the standard 6" overlap method. For comparison, shingles made of pure sulfur were also nailed to a test deck. These shingles were extremely brittle and cracked badly on nailing, such that pre-drilling of the nail holes was necessary. Similarly, test decks were covered with wooden cedar shake shingles and Class C asphalt shingles.

A fire test apparatus was constructed of the same basic design used in ASTM E-108. The air velocity, burner capacity, flame size, and eave design were such that the flame played uniformly over the top surfaces of the test decks.

An exposure time of 18.5 minutes was set, based upon preliminary tests indicating that burning on the most combustible shingles, cedar shake, had proceeded through the shingles, felt, and plywood after 18.5 minutes.

The results of this test are summarized below, proceeding from the worst performance to the best.

Wooden Cedar Shake Shingle Deck

This roofing material burned with great intensity. Flames extended 2' beyond the top edge of the roof. The roof temperature quickly stabilized at 871° C., and large amounts of white smoke were produced. The plywood decking that was not burned through was badly charred.

Asphalt Shingle Deck

This roofing material burned with slightly less intensity than the wooden cedar shake roof, but flames still extended 2' beyond the top edge of the roof. The roof temperature quickly stabilized at 787° C. and large amounts of black smoke were produced. The plywood decking was badly charred, and there was one small 2" hole burned through it.

Sulfur Shingle Deck

This roofing material burned with excessive melting of the sulfur, which in turn flowed and dripped over the eave, transporting the fire with it and spreading the fire. The temperature quickly stabilized at 565° C. and finally there was a small amount of white smoke and very little visible flame. $SO_2$ generation was extreme. There was some charring of the plywood deck.

Compositions A, B, C and D Shingle Decks

The performances of the test decks made with shingles from the different plasticized-sulfur compositions of the invention were very similar. Time to reach ignition, time to burning the full length of the roof and time for the roof temperature to stabilize were generally longer than for the other roof, in some cases by a factor of 2. There was no running or dripping of the roofing material, as experienced with the asphalt or pure sulfur roofs. The roofs did not burn with intensity, and there were no extending flames. The roof temperature stabilized at approximately 565° C., which was 287° C. and 204° C. less than for the cedar and asphalt roofs, respectively. There was a small amount of white smoke and very little visible flame. $SO_2$ generation was not extensive, as with the pure sulfur roof. There was no charring of the plywood roof decks.

TABLE II

| | Min. | FIRE TEST DATA | Temp. °C. |
|---|---|---|---|
| | | Asphalt Shingle Deck | |
| | 2.5 | Asphalt melted & bubbling full length of roof | 427 |
| | 4.0 | Ignition at bottom of roof | 649 |
| | 5.0 | Burning full length of roof with excessive dripping asphalt | 759 |
| | 13.0 | Burning full length of roof with excessive dripping asphalt | 787 |
| | 18.5 | Stopped test | 787 |
| | | Cedar Shake Deck | |
| (1) | 1.0 | Ignition at bottom | 593 |
| (2) | 1.5 | Burning full length | 649 |
| (3) | 4.5 | Burning full length | 705 |
| (4) | 6.5 | Burning full length | 871 |
| (5) | 12.0 | Burning full length | 871 |
| (6) | 18.5 | Burned through | 871 |
| | | Pure Sulfur Deck | |
| (1) | 1.0 | Melting on surface | 343 |
| (2) | 1.5 | Ignition at bottom of roof | 538 |
| (3) | 4.0 | Burning full length of roof. Excessive melted yellow sulfur running and dripping | 565 |
| (4) | 7.0 | Excessive melted, black sulfur running down face of roof and off eave | 565 |
| (5) | 12.0 | Running and dripping stopped | 565 |
| (6) | 18.5 | Stopped test | 565 |
| | | Composition A Deck | |
| | 1.5 | Ignition at bottom of roof | 477 |
| | 4.0 | Burning full length of roof | 538 |
| | 7.0 | Burning full length of roof | 565 |
| | 12.0 | Burning full length of roof | 574 |
| | 14.5 | Burning full length of roof | 565 |
| | 18.5 | Burning full length of roof | 565 |
| | | Composition B Deck | |
| | 2.0 | Ignition at bottom of roof | 399 |
| | 3.0 | Burning full length of roof | 427 |
| | 7.0 | Burning full length of roof | 593 |
| | 12.0 | Burning full length of roof | 649 |
| | 14.5 | Burning full length of roof | 677 |
| | 18.5 | Burning full length of roof | 677 |
| | | Composition C Deck | |
| | 4.0 | Ignition at bottom of roof | 427 |
| | 5.0 | Burning full length of roof | 477 |
| | 7.0 | Burning full length of roof | 565 |
| | 12.0 | Burning full length of roof | 565 |
| | 14.5 | Burning full length of roof | 565 |
| | 18.5 | Burning full length of roof | 593 |
| | | Composition D Deck | |
| | 5.0 | Ignition | 427 |
| | 6.0 | Burning full length of roof | 538 |
| | 9.0 | Burning full length of roof | 574 |
| | 12.0 | Burning full length of roof | 565 |
| | 14.5 | Burning full length of roof | 565 |
| | 18.5 | Burning full length of roof | 565 |

From this series of tests, it was concluded that from the standpoint of fire resistance the sulfur-based shingles were better than wooden cedar shingles or Class C asphalt shingles as used in residential construction. From these tests, it is reasonable to assume that plasticized sulfur-based shingles should easily pass ASTM E-108 requirements and offer a measure of fire resistance to residential construction now only available in specialized grades of shingles. It is possible to further improve the fire resistance of the formulations by incorporating additives into them. It is also possible to improve the fire resistance of the shingles made from these compositions by the use of exterior coatings over them. Thus, there are a variety of ways to improve upon the fire retardancy of the sulfur-based shingles within the scope of this invention.

EXAMPLE 2

Using the following method, various sulfur-based roof shingles were prepared and screened for ease of handling and workability.

One or more layers of glass fiber mat were clamped between two ½" square aluminum bars. This flag of glass fiber mat was then dipped into the vat of molten sulfur Composition E that was maintained at a temperature of 150° C. After immersion for approximately 10 minutes with movement to obtain saturation, the mat was removed. Upon removal there was excess sulfur formulation on the mat. The mat was then released from the holding bars, put on a hot sheet of oiled aluminum and placed in an oven. When the mat and the sheet had all stabilized at 150° C., it was removed from the oven along with a 3"-diameter aluminum roller which was also at 150° C. The mat was then rolled to remove the excess sulfur coating compound to provide a uniform thickness and a smooth surface. After rolling there is very little excess sulfur compound on the top, such that the mat structure impregnated with the plasticized-sulfur composition is visible just as the mat structure is visible on the bottom of an asphalt shingle. At this point, the top of the plasticized-sulfur based shingle became the bottom of the shingle as it was turned over and the roofing granules were applied in excess, after which the shingle was returned to the oven and again temperature-stabilized at 150° C. to allow the granules to imbed themselves in the sulfur formulation. The compositions of the shingles prepared using this method are summarized below:

| | | |
|---|---|---|
| Asphalt Shingle (Class C - Residential) | | |
| Paper Felt | | 30 grams |
| Asphalt | | 210 grams |
| Granules | | 217 grams |
| | Total | 457 grams |
| Sulfur-Based Shingle One-Layer Mat - No Granules | | |
| One glass fiber mat | | 6 grams |
| Composition E | | 140 grams |
| | Total | 146 grams |
| Sulfur-Based Shingle Two-Layer Mat - No Granules | | |
| Two glass fiber mats | | 12 grams |
| Composition E | | 193 grams |
| | Total | 205 grams |
| Sulfur-Based Shingle Three-Layer Mat - No Granules | | |
| Three glass fiber mats | | 18 grams |
| Composition E | | 262 grams |
| | Total | 280 grams |
| Sulfur-Based Shingle One-Layer Mat - Granules | | |
| One glass fiber mat | | 6 grams |
| Composition E | | 202 grams |
| Granules | | 121 grams |
| | Total | 329 grams |
| Sulfur-Based Shingle Two-Layer Mat - Granules | | |
| Two glass fiber mats | | 12 grams |
| Composition E | | 256 grams |
| Granules | | 110 grams |
| | Total | 378 grams |
| Sulfur-Based Shingle Three-Layer Mat -Granules | | |
| Three glass fiber mats | | 18 grams |
| Composition E | | 502 grams |
| Granules | | 216 grams |
| | Total | 736 grams |

These shingles present a range of properties from a very thin and flexible shingle to a heavy, rigid shingle. They indicate that there is considerable latitude in the construction of shingles with the use of the plasticized-sulfur compositions. Since the use of mat and granules is essentially comparable to what is used in Class C asphalt shingles, the major difference between the two is the superior fire resistance of the plasticized sulfur-based shingles. A unique and unexpected feature of the sulfur-based shingles is their flexibility. They have virtually the same degree of flexibility as asphalt shingles.

What is claimed is:

1. A non-asphaltic sulfur-based roof shingle having good fire resistance consisting essentially of a fibrous base mat impregnated with a plasticized-sulfur composition comprising from about 30% to about 98% by weight sulfur.

2. A roof shingle according to claim 1 which has a layer of roofing granules embedded in the plasticized-sulfur composition.

3. A roof shingle according to claim 1 wherein the plasticized-sulfur composition comprises from about 30 to 98% by weight sulfur, from about 0.2 to 20% by weight plasticizer, and from about 1 to 70% by weight filler.

4. A roof shingle according to claim 3 wherein the plasticizer is dicyclopentadiene.

5. A roof shingle according to claim 3 wherein the filler is mica, hydrated alumina, glass fiber, or mixtures thereof.

6. A roof shingle according to claim 1 wherein the plasticized-sulfur composition comprises sulfur, dicyclopentadiene, mica and glass fiber.

7. A roof shingle according to claim 1 wherein the plasticized-sulfur composition comprises sulfur, dicyclopentadiene, mica, glass fiber, hydrated alumina, tetrabromophthalic anhydride and ammonium polyphosphate.

8. A roof shingle according to claim 1 wherein the plasticized-sulfur composition comprises sulfur, dicyclopentadiene, mica and glass fiber.

9. A roof shingle according to claim 1 wherein the plasticized-sulfur composition comprises sulfur, dicyclopentadiene, glass fiber, sand and hydrated alumina.

10. A roof shingle according to claim 1 wherein the shingle has a final thickness of at least 50 mil.

* * * * *